US009480619B2

(12) United States Patent
Frankian

(10) Patent No.: US 9,480,619 B2
(45) Date of Patent: Nov. 1, 2016

(54) WALKING ASSISTANCE APPARATUS

(71) Applicant: Justin Frankian, Woodland Hills, CA (US)

(72) Inventor: Justin Frankian, Woodland Hills, CA (US)

( * ) Notice: Subject to any disclaimer, the term of this patent is extended or adjusted under 35 U.S.C. 154(b) by 0 days.

(21) Appl. No.: 15/172,332

(22) Filed: Jun. 3, 2016

(65) Prior Publication Data

US 2016/0279015 A1 Sep. 29, 2016

Related U.S. Application Data

(63) Continuation-in-part of application No. 15/019,757, filed on Feb. 9, 2016, which is a continuation-in-part of application No. 14/791,512, filed on Jul. 6, 2015.

(60) Provisional application No. 62/021,408, filed on Jul. 7, 2014.

(51) Int. Cl.

| | |
|---|---|
| ***A61H 3/00*** | (2006.01) |
| ***A63B 22/00*** | (2006.01) |
| ***A63B 71/00*** | (2006.01) |
| ***A61H 3/04*** | (2006.01) |

(52) U.S. Cl.

CPC ..... *A61H 3/04* (2013.01)

(58) Field of Classification Search

CPC .. A63B 22/20; A63B 22/00; A63B 21/4005; A63B 21/4007; A63B 21/4011; A63B 21/00069; A63B 21/00181; A63B 23/04; A63B 23/0458; A63B 21/0464; A63V 23/0405; A61H 3/00; A61H 3/04

USPC ..... 482/51, 66–69, 74, 139, 142, 148

See application file for complete search history.

(56) References Cited

U.S. PATENT DOCUMENTS

| | | | | |
|---|---|---|---|---|
| 4,890,853 | A * | 1/1990 | Olson | A61G 5/00 280/47.4 |
| 4,907,794 | A * | 3/1990 | Rose | A61H 3/04 135/67 |
| 4,948,156 | A * | 8/1990 | Fortner | A61G 5/14 180/907 |
| 6,296,263 | B1 * | 10/2001 | Schultz | A61H 3/04 135/67 |
| 6,338,493 | B1 * | 1/2002 | Wohlgemuth | A61G 5/00 135/66 |
| 7,001,313 | B1 * | 2/2006 | Crnkovich | A61H 3/04 135/67 |
| 7,294,094 | B1 * | 11/2007 | Howle | A61H 3/00 135/67 |
| 7,341,543 | B2 * | 3/2008 | Dandy | A63B 22/20 280/271 |
| 7,470,220 | B2 * | 12/2008 | Hernandez | A63B 21/012 188/25 |
| 7,559,560 | B2 * | 7/2009 | Li | A61H 3/04 16/35 R |

(Continued)

*Primary Examiner* — Stephen Crow
*Assistant Examiner* — Garrett Atkinson
(74) *Attorney, Agent, or Firm* — Michael L. Greenberg, Esq.; Greenberg & Lieberman, LLC

(57) ABSTRACT

A walking assistance device configured to permit the independent movement of an individual via simulated weight reduction is described. The device is configured to partially suspend a portion of a user's weight via a seat-lifting system, facilitating the movement of a user with experiencing difficulty walking without assistance. The system of the device preferably employs a seat, a hydraulic or electric seat-lift mechanism, a seat restraint, a frame, wheels, a brake system, and a power source. The seat-lift mechanism is configured to rise and lower the seat, enabling the user to control the percentage of weight lifted, while the feet of the user remain in partial contact with the floor. The frame forms the structure and support of the device, and is configured to move laterally via wheels on the bottom of the frame of the device.

9 Claims, 4 Drawing Sheets

FIG. 1

(56) References Cited

U.S. PATENT DOCUMENTS 7,669,863 B2 * 3/2010 Steiner ..... A61G 5/14 280/250.1
7,708,120 B2 * 5/2010 Einbinder ..... A61H 3/04 188/19
7,900,940 B1 * 3/2011 Vidmar ..... A61H 3/008 280/271
7,935,030 B1 * 5/2011 Nesbitt ..... A61H 3/04 482/142
8,151,812 B2 * 4/2012 Razon ..... A61H 3/04 135/66
8,152,699 B1 * 4/2012 Ma ..... A61H 1/0229 482/54
8,303,473 B2 * 11/2012 Gutierrez ..... A63B 21/00 482/121
8,663,133 B2 * 3/2014 Johnson ..... A61F 5/24 482/78
2004/0063550 A1 * 4/2004 Harris ..... A61H 3/008 482/69
2006/0113147 A1 * 6/2006 Harris ..... A62B 35/0093 182/3
2007/0194547 A1 * 8/2007 Steiner ..... A61G 5/14 280/87.021
2008/0129016 A1 * 6/2008 Willis ..... A61G 5/08 280/639
2009/0045021 A1 * 2/2009 Einbinder ..... A61H 3/04 188/2 D
2009/0298653 A1 * 12/2009 Rodetsky ..... A61H 3/04 482/69
2010/0083994 A1 * 4/2010 Liu ..... A61H 3/04 135/67
2012/0000496 A1 * 1/2012 Razon ..... A61H 3/04 135/67
2012/0187661 A1 * 7/2012 Kim ..... A61H 3/04 280/650

* cited by examiner

WALKING ASSISTANCE APPARATUS

This application is a Continuation-in-Part of Continuation-in-Part application Ser. No. 15/019,757, filed on Feb. 9, 2016, which claims the benefit of non-provisional application Ser. No. 14/791,512, filed on Jul. 6, 2015, which claims priority to provisional patent application No. 62/021,408, filed on Jul. 7, 2014, and priority is claimed thereto.

FIELD OF THE PRESENT INVENTION

The present invention pertains to walkers and similar walking assistance devices, and more specifically relates to a walking assistance device configured to permit the independent movement of the individual with minimal or decreased use of the user's hands or legs for continual support of the user.

BACKGROUND OF THE PRESENT INVENTION

In the past, the majority of walkers have been used for aiding elderly, ambulatory patients in walking, whether in nursing homes, hospitals, rehabilitation centers, or in their own homes. Traditionally, these walkers consisted of a four-legged frame with front brace. Often, the two rear legs would be capped with spherical, soft accessories (i.e. tennis balls) to inhibit spontaneous, erratic movements and slippage.

Conventional wheelchairs are often employed to help individuals to move, however these offer little benefit in terms of exercise for the legs of the user. To exercise the legs, the aforementioned walkers are frequently used, which users are able to lean on and hold on to as they move about. Walkers such as these cause upper body strain, as the user often must lean heavily on the handles of the walker in order to reduce his or her weight enough to move without severe discomfort. Therefore, there is a need to change this paradigm such that a user need not rely heavily on leaning on a walker in order to move without discomfort.

Prior art allowed for support for elderly patients with compromised use of their lower extremities to hold themselves up with the walker. It also required significant strength in the patient's arms and upper body to lean on the walker to assist their legs. However, prior art failed to provide a means of movement for patients with very limited use of the lower extremities and an inability to balance and hold their upper torso upright. Similar devices have been created for use by children, also known as child walkers. These walkers are conventionally configured with a seat that holds the child at a fixed distance from the ground, whereas the child's legs would dangle below, in contact with the ground. At the bottom, a frame with multiple wheels aids in the movement of the child, for which the child provided propulsion through the use of the legs. The purpose and function of these devices were to prevent a child from falling while learning to walk.

Prior art known to the field has also failed in providing a means of holding up the upper torso of the user's body and allowing users with disabilities in the lower extremities to propel themselves manually. Some prior art attempted to solve the problem of aiding patients with limited faculty in the lower extremities by providing an external source of power (i.e. motorized wheels) that would propel the patient horizontally, however this ignored any potential rehabilitative, therapeutic effects by leaving the patient out of the propulsion process.

Furthermore, prior art also provided a means of supporting the patient's upper torso through use of a height adjustable hoist, however failed to address facilitating the patient's input and/or making it easier for providing horizontal propulsion via the lower extremities for patients. All prior art required that the users full weight be supported by the strength of his or her legs and/or partially supported with the strength of the arms.

Thus, there is a need for a new walker aide device configured to assist the user in moving without the need for his or her weight to be completely supported by the strength of the legs of the individual or the arms of the individual. Such a device is preferably equipped with a telescoping, bicycle-style seat, configured to enable the user to rest a portion of his or her weight on the bicycle-style seat while walking.

SUMMARY OF THE PRESENT INVENTION

The present invention is a walking assistance device configured to aide an individual in independent movement. The device is configured to partially suspend a portion of the weight of the user via a partial seat to make it easier for the user to support his or herself while moving.

The present invention overcomes the debilitating effects of a wheelchair for a majority of patients who rely on wheels to move around. It also minimizes the risk of falling for those who rely on walking aids such as canes and walkers, within the limitations of the terrain.

The present invention consists of a four-legged frame, with two large fixed wheels situated at the bottom of each rear leg, and two smaller, free rotating wheels (casters) disposed at the bottom of each front leg. A seat restraint is in communication with the seat of the present invention, and connects the thighs of the user to the seat for safety and security during use. The patient is strapped to the seat via the seat restraints as he or she partially sits on the seat, to which the seat-lift mechanism can raise the seat (whereby the patient is lifted) to reduce the weight of the patient as needed according to his or her condition and strength. This reduction in weight allows the patient to implement the use of his or her legs and feet to propel him or herself vertically and/or horizontally with respect to the floor as the plane of movement with less force than would usually be required to move if the full weight of the patient were placed on the lower extremities of the patient.

BRIEF DESCRIPTION OF THE DRAWINGS

The present invention will be better understood with reference to the appended drawing sheets, wherein.

DETAILED DESCRIPTION OF THE PREFERRED EMBODIMENT

Figure 1:
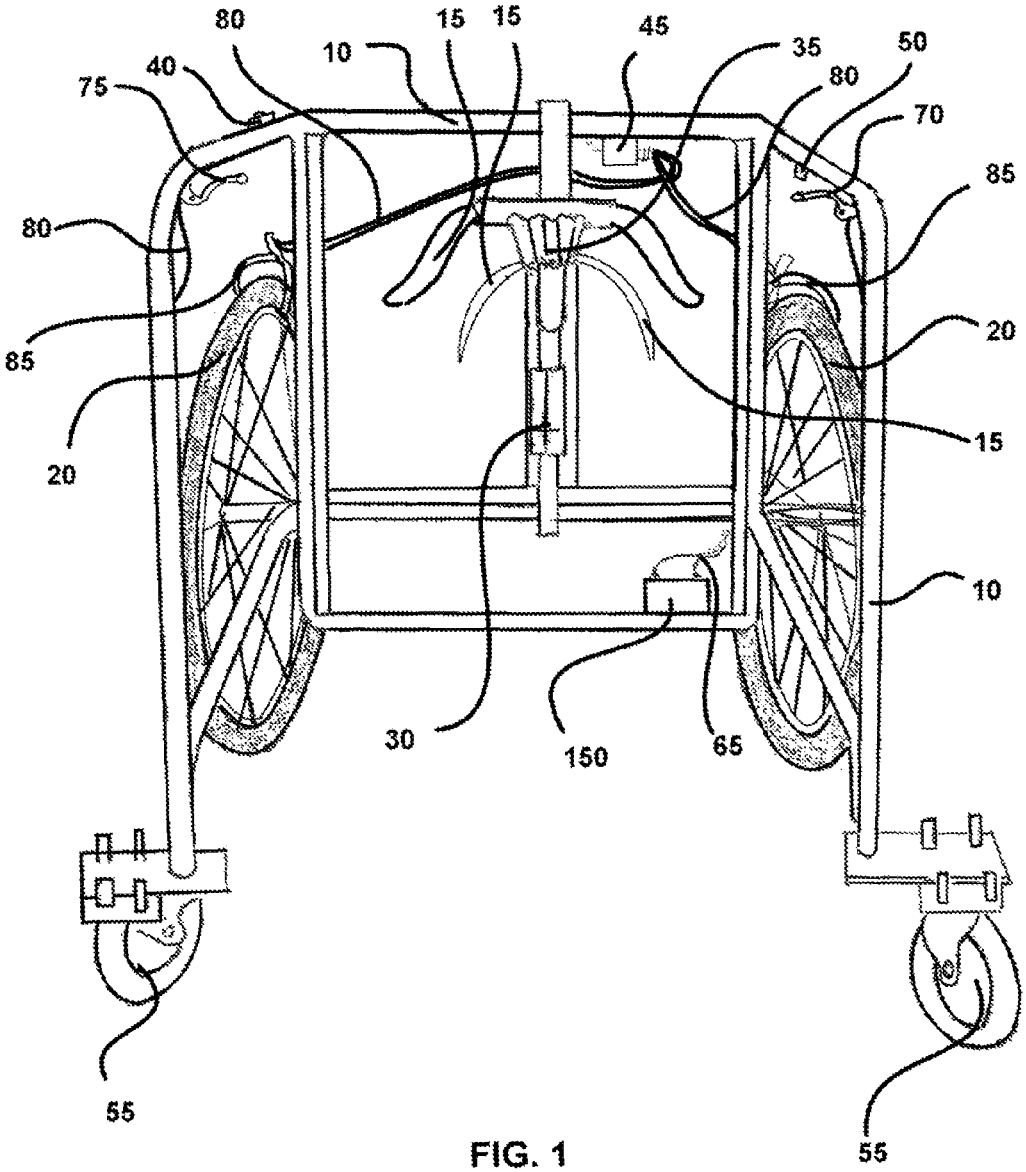
FIG. 1 displays a front perspective view of the preferred embodiment of the present invention as seen from the front, detailing the profile of the present invention.

The present invention generally comprises a frame (10), wheels (20), a seat (35), a seat restraint (15), and a hydraulic seat-lift mechanism (30). The seat-lift mechanism (30) is powered via a DC power source (150), which is preferably disposed on or within the frame (10) of the present invention. The seat-lift mechanism (30) is preferably a hydraulic or electric piston or cylinder, configured to facilitate the raising or lowering of the seat (35) at the will and need of the user. As such, the present invention is designed such that the user may partially suspend his or her weight on the seat, while still using his or her legs to move, allowing the user to exercise. This is in contrast to conventional wheelchairs, which do not permit the user to exercise his or her legs during movement.

Various embodiments of invention are now described in more detail with reference to the accompanying figures and drawings, where some but not all embodiments of invention are displayed and/or illustrated in the figures. As expected, these inventions may be consolidated into many different forms and should not be interpreted as limited to the embodiments set forth herein; these embodiments are made available so that this disclosure will fulfill relevant legal requirements.

Figure 2:
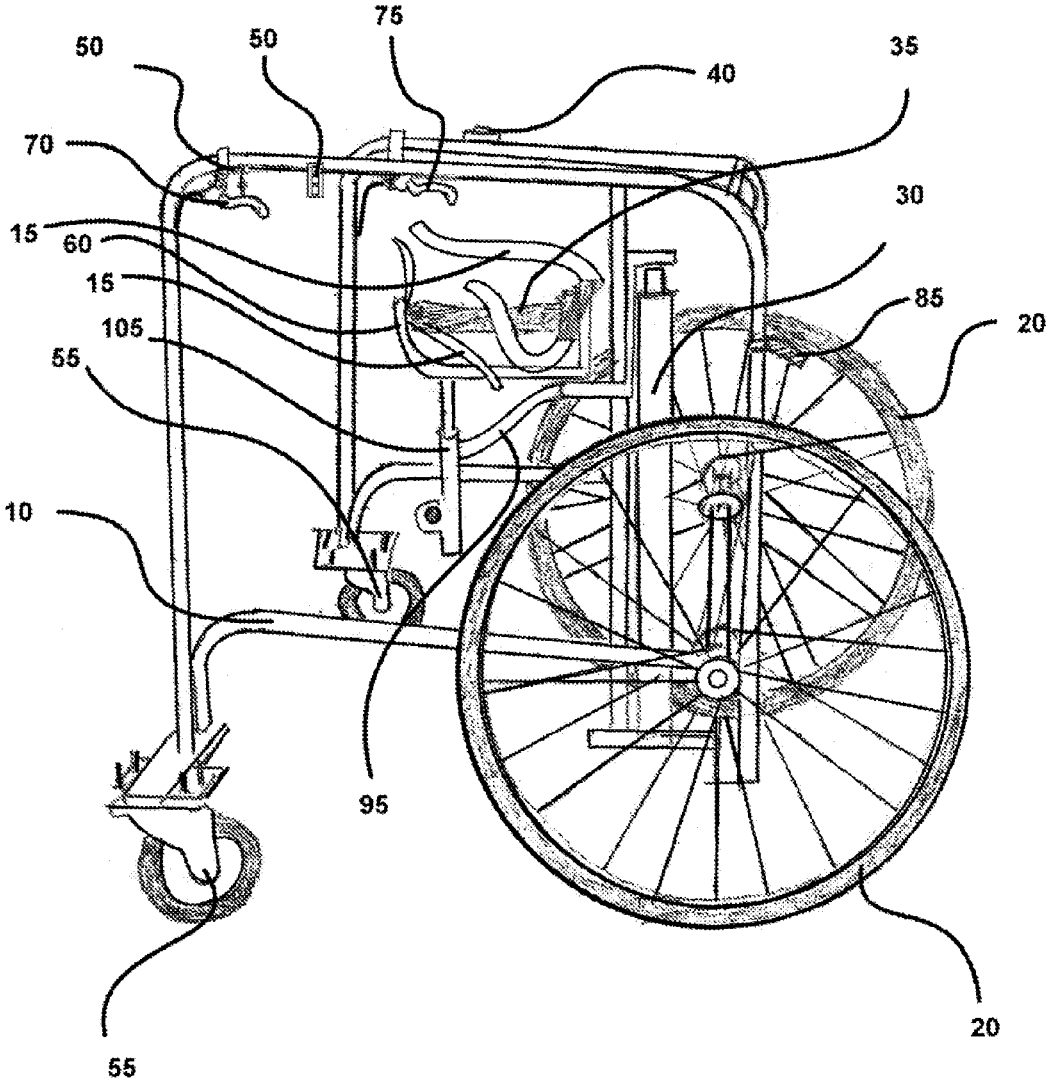
FIG. 2 shows a left side view of the preferred embodiment of the present invention.

FIG. 1 portrays the preferred embodiment of the invention. The frame (10) of the present invention preferably consists of steel and/or aluminum tubing, running horizontally and vertically and forward/backward (similar to that of a conventional walker), which provides the structural foundation for housing other devices of the invention, and for supporting the weight and balance of the patient. These tubings of the frame (10) may be continuous, bent forms and/or different pieces welded and/or bolted together, as shown in FIG. 1 and FIG. 2. A 12 volt DC power source (150) is preferably situated on the bottommost horizontal tubing (though may be located on any part of the frame (10) where convenient and not in opposition to the function of the device), with an electrical wires (65) that connects the power source (150) to an adjustable actuator connecting power to the seat-lift mechanism (30) and the brake assemblies (85) (if a powered brake is used) via electrical wires (65). The seat (35) as shown in FIG. 1, is preferably composed of, or with, at least one bungee cord. The seat (35) is preferably affixed via a seat bracket (60) configured to removably secure the seat (35) in position. Additionally, a primary seat height adjustment bracket (105) is disposed in communication with the seat (35), and is configured to facilitate the adjustment of the height of the seat (35) to suit the height of various patients. This is a one-time adjustment unrelated to the seat-lift mechanism (35). A three-position seat lifting and lowering switch (50) is preferably disposed on the left side of the present invention, and is in communication with the seat-lift mechanism (30) via electrical wires (65). The three-position seat lifting and lowering switch (50) is in communication with the power source (150) of the present invention via electrical wires (65) as well. The seat (35) is also preferably equipped with a seat lift arm (95), which provides leverage and facilitates the stable lifting and lowering of the seat (35) via the seat-lift mechanism (30).

The brake assemblies (85) are most commonly in the locked or 'on' state, ensuring that the user remains in the desired position in height (via percentage of weight suspended) and placement during motion while using the present invention. It is envisioned that the brake assemblies (85) are bicycle-style brake assemblies, functioning similar to that of conventional bicycle brake systems. Two omni-directional casters (55), having free rotation about their vertical axes, are each situated on the two front legs of the frame (10). If need be, additional casters (55) may be added to provide more stability.

The present invention is preferably equipped with brake pads which are configured to grip or clamp on the two sides of the rim of each wheel (20) when a left wheel brake lever (70) and/or a right wheel brake lever (75) are inactive (not pulled by the user). The pads' function is to prevent slipping and unwanted forward/rearward/sideward (planar) movement when the user is at rest. The use of the assembly is preferably controlled by the left wheel brake lever (70) and the right wheel brake lever (75), or both.

It should be understood that the brake assemblies (85) of the present invention are preferably maintained in the 'on' or 'activated' position such that the use of the left wheel brake lever (70) and the right wheel brake lever (75) releases the brakes, rather than activates them. Either handle can release the normally-on brakes mechanically to lift the brake pads off of the rims of the wheels (20). Therefore, the brake pads of the brake assemblies (85) are normally in contact with the wheels (20) so the user can maintain stability, and remain in place when the user's hands are not on the brakes.

Once the user desires to move, then the left wheel brake lever (70) and the right wheel brake lever (75) can be activated to lift the brake pads off of the rims of the wheels (20), or to alternately release the brake pads disposed against the floor in alternate embodiments of the present invention. The brake assemblies (170) need not be controlled by the left wheel brake lever (70) and the right wheel brake lever (75) in all embodiments of the present invention, but can also be activated through the use of buttons, capacitive touch sensors, micro-controllers, voice, or any sort of mechanism that would allow a patient with limited use of the hands to easily manipulate the current or tension of the brake assemblies (85). If powered brakes are employed instead of manual brakes, the brake assemblies (85) are connected to the power source (150) via the electrical wires (65). The electrical wires (65) consist of wiring that runs along (and/or within) the vertical tubings of the frame (10), from where the left wheel brake lever (70) and the right wheel brake lever (75) are situated.

The primary function of the present invention lies in the weight-reducing seat-lift mechanism (30), which is powered by the power source (150) through the electrical wires (65). The seat-lift mechanism (30) is configured to enable the user to raise or lower the seat according to his or her height and preference. Additionally, the seat-lift mechanism (30) is configured to compress slightly during use, providing the user with a form of shock absorption, making the seat (35) of the present invention more comfortable for extended use. It is envisioned that the seat-lift mechanism (30) may employ electric lift or hydraulic lift.

As a result, patients who are semi-mobile, disabled, and/or weak in the lower extremities would be able to use minimal strength in exercises such as gait training and would be able to mimic the effects of water therapy, however in a non-aqueous environment, i.e. the surface, all without the need for strength from the upper body and arms. The invention overcomes the debilitating effects of a wheelchair for a majority of patients who rely on wheelchairs or wheeled walkers to move around. Use of the present invention also minimizes the risk of falling for those who rely on walking aids such as canes and walkers, within the limitations of the terrain.

Alternate embodiments of the present invention may include variations on the frame (10), wheels (20), and design of the brake assemblies (85). For example, push handles may be disposed at the rear of the tubing of the frame (10) to facilitate pushing a user in the device of the present invention by a nurse or assistant from the rear, similar to a wheelchair. This can be helpful for expediting the training process of use for a user of the present invention. Additionally, an electric, motorized wheel may be included in some embodiments of the present invention to facilitate use of the present invention as an extra mobility option if needed.

All embodiments of the present invention preferably employ a 12 volt D.C. battery as the power source (150), powering the seat-lift mechanism (30) as well as the brake portion of the present invention in embodiments of the present invention employing a powered brake. Preferred embodiments of the present invention employ a manual brake, which can be used without the need to route power from the power source (150), as shown in FIG. 1. The manual brake of the present invention is preferably a bicycle-style brake assembly (85). Alternate embodiments of the present invention are preferably equipped with an electric brake solenoid (45), which facilitates electric powered braking. Such an embodiment is preferable to elderly individuals, or those with impaired hands, as the such a braking system equipped with the electric brake solenoid (45) requires much less effort to activate/deactivate the brakes of the present invention than that of the manual brakes employing the left wheel brake lever (70) and right wheel brake lever (75), and is instead envisioned to be activated with the push of a button.

Figure 3:
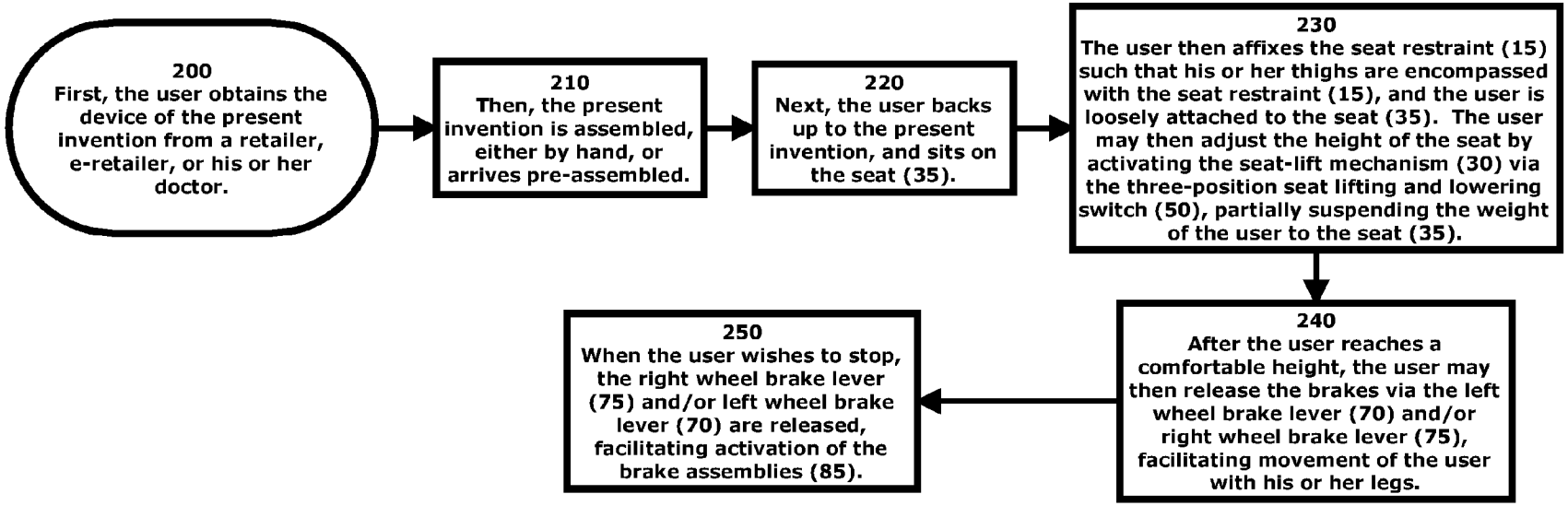
FIG. 3 displays a flow chart of the process of use of the present invention.
Figure 4:
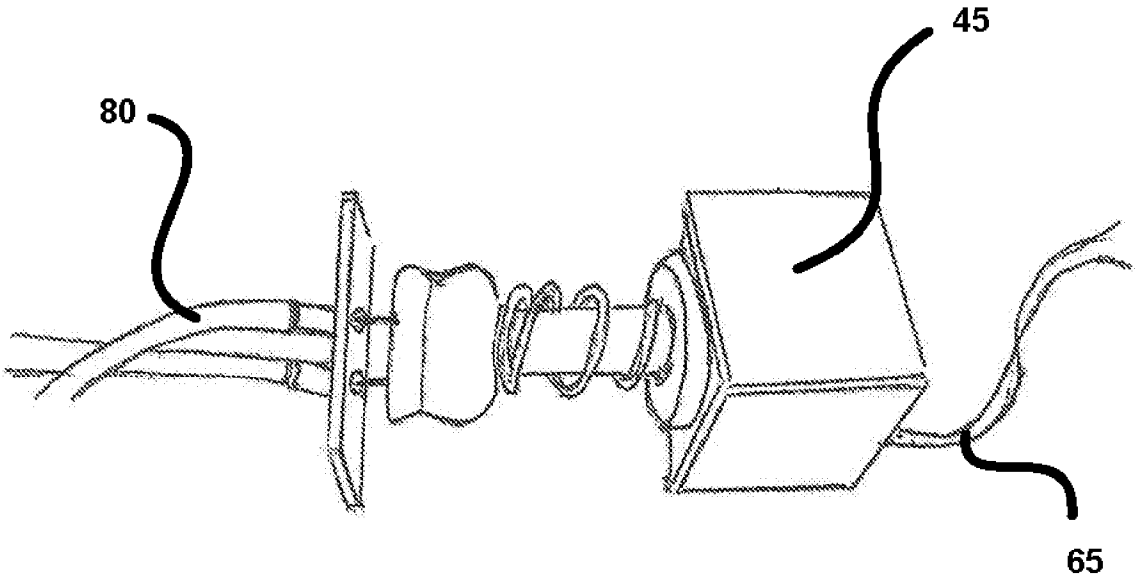
FIG. 4 displays a top side view of the electric brake solenoid of an embodiment of the present invention.

The preferred process of use of the present invention, as shown in FIG. 3, is preferably as follows:

First, the user obtains the device of the present invention from a retailer, e-retailer, or his or her doctor. (200) Then, the present invention is assembled, either by hand, or arrives pre-assembled. (210) Next, the user backs up to the present invention, and sits on the seat (35). (220) The user then affixes the seat restraint (15) such that his or her thighs are encompassed with the seat restraint (15), and the user is loosely attached to the seat (35). The user may then adjust the height of the seat by activating the seat-lift mechanism (30) via the three-position seat lifting and lowering switch (50), partially suspending the weight of the user to the seat (35). (230) After the user reaches a comfortable height, the user may then release the brakes by gripping or compressing the left wheel brake lever (70) and right wheel brake lever (75), facilitating movement of the user with his or her legs. (240) When the user wishes to stop, the right wheel brake lever (75) and left wheel brake lever (70) are both released, facilitating activation of both brake assemblies (85). (250) As such, it should be understood that, in order to stop both wheels (20) of the present invention, both the right wheel brake lever (75) and the left wheel brake lever (70) must be released. Therefore, in order to move backward or forward in a straight direction, both brake assemblies must be released by the user gripping on both the right wheel brake lever (75) and the left wheel brake lever (70). Releasing only one brake assembly (85) by gripping only the left wheel brake lever (70) causes the frame (10) and the user to pivot on the restrained wheel (20) on the right of the present invention. Conversely, releasing only one brake assembly (85) by gripping only the right wheel brake lever (75) causes the frame (10) and the user to pivot on the restrained wheel (20) on the left of the present invention.

Additionally, it should be understood that some embodiments of the present invention employs electric solenoid (45) to facilitate an electric powered brake. The electric brake is preferably an optional feature, which is used in lieu of the mechanical brakes which employ traditional levers to manually pull the brakes, shown as the left wheel brake lever (70) and right wheel brake lever (75). This requires one electrical switch (40) connected by a electrical wires (65) to an electric solenoid (45) then via cables (80) to the brake assemblies (85). Again this feature ideal for those patients who cannot manipulate the brake levers without discomfort. The patients simply place their hand on the electrical switch (40) to release both brakes at the same time. A third optional embodiment of the present invention may utilize the left wheel brake lever (70) and the right wheel brake lever (75) as electric switches, connected to 2 different solenoids that would each control one brake assembly. Such an embodiment would facilitate independent braking similar to the manual, mechanical brakes of the preferred embodiment of the present invention, enabling easier pivoting of the present invention.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A weight suspension and motion device for a user walking comprising:

a frame;

a seat, said seat in communication with said frame;

a seat restraint, said seat restraint disposed adjacent to said seat;

an electric seat lift mechanism, said seat-lift mechanism disposed on said frame and configured to compress slightly during use to provide shock absorption; said seat lift mechanism in communication with said seat via a height adjustment bracket connected to said seat and a lift arm connected to said height adjustment bracket and said seat lift mechanism;

wheels, said wheels disposed at a rear of said frame;

casters, said casters disposed at a front of said frame;

caster wheels, wherein said caster wheels are affixed to said casters; wherein said caster wheels are configured to lock; wherein said casters are in communication with said frame; at least one brake assembly; at least one brake pad; an electric brake switch; wherein said electric brake switch is in communication with an electric brake solenoid via electrical wires wherein said electric brake solenoid is in communication with said at least one brake assembly via at least one brake cable; and wherein said electric brake switch is in communication with a power supply via electrical wires;

wherein said seat restraint is configured to extend around thighs of the user; and wherein said seat is configured to support a portion of the weight of the user while facilitating the use of feet of the user to walk.

2. The device of claim 1, further comprising:

brake switch release handles;

wherein said brake switch release handles are in communication with said brake assemblies via brake cables;

wherein said cables release said brake pads of said brake assemblies upon retraction via said brake switch release handles; and wherein said brake switch release handles are disposed on said frame.

3. The device of claim 2, wherein said brake switch release handles are configured to release said brake assemblies when squeezed, permitting movement of said wheels.

4. The device of claim 2, wherein said brake pad and said brake assembly are configured to clamp to a rim of the wheels to facilitate a stop.

5. The device of claim 1, wherein said seat restraint is configured to strap to thighs of the user.

6. The device of claim 5, further comprising:

a power supply, said power supply in communication with said seat-lift mechanism via electrical cables;

wherein said seat-lift mechanism is an electric piston; and a switch, said switch configured to activate said seat-lift mechanism to lift said seat, partially suspending the weight of the user, reducing the weight supported by the feet of the user.

7. The device of claim 5, further comprising:

a power supply, said power supply in communication with said seat-lift mechanism via electrical cables;

wherein said seat-lift mechanism is a hydraulic cylinder; and a switch, said switch configured to activate said seat-lift mechanism to lift said seat, partially suspending the weight of the user, reducing the weight supported by the feet of the user.

8. A method for walking with assistance due to a reduced body weight via suspension comprising: providing the device of claim 1; sitting on the seat; connecting the seat restraint to the thighs of the user; wherein the seat lift mechanism is a hydraulic seat-lift mechanism; powering the hydraulic seat-lift mechanism with a battery; activating the seat-lift mechanism; the hydraulic seat-lift mechanism lifting the seat, in turn lifting a portion of the weight of the user, effectively reducing the weight of the user; the user depressing at least one brake switch handle, deactivating the brakes; and the user walking easier with less strain exerted by the legs of the user to support the weight of the user.

9. The method of claim 8, wherein the brakes are electrically powered via the battery.

* * * * *